United States Patent [19]

Waren

[11] Patent Number: 4,924,843

[45] Date of Patent: May 15, 1990

[54] MASONRY SAW JIG

[76] Inventor: Jerry B. Waren, 4044 Hampton La., Shreveport, La. 71107

[21] Appl. No.: 276,490

[22] Filed: Nov. 28, 1988

[51] Int. Cl.[5] ..... B28D 7/04

[52] U.S. Cl. ..... 125/35; 51/240 A; 269/60; 269/289 R; 269/902

[58] Field of Search ..... 51/216 R, 216 A, 217 A, 51/240 A; 125/13 R, 13 SS, 14, 35; 83/708; 269/59, 60, 76, 285, 289 R, 309, 902

[56] References Cited

U.S. PATENT DOCUMENTS

| | | | |
|---|---|---|---|
| 731,686 | 6/1903 | Johnson | 51/240 A |
| 1,310,263 | 7/1919 | van der Meulen | 51/240 A |
| 1,355,809 | 10/1920 | Bryant | 51/240 A |
| 2,464,117 | 3/1949 | Coates | 125/35 X |
| 3,168,893 | 2/1965 | Johnson | 125/35 X |
| 3,463,137 | 8/1969 | Hare | 125/35 |
| 4,254,946 | 3/1981 | Kerr et al. | 269/285 X |
| 4,315,494 | 2/1982 | DiPlacido | 125/35 |
| 4,318,537 | 3/1982 | Dorman et al. | 269/289 R X |

*Primary Examiner*—Robert P. Olszewski

*Attorney, Agent, or Firm*—John M. Harrison

[57] ABSTRACT

A jig for use with masonry saws for supporting and cutting flat and brick-shaped masonry material such as bricks and tile. The jig includes a frame, a "V"-shaped material-supporting bed pivotally mounted on the frame and an adjustment mechanism for adjusting the angle of the "V"-shaped bed with respect to the frame. The adjustment mechanism includes a support bar pivotally affixed to the material-supporting bed at one end and adjustably attached to the frame by a bolt fastened to the opposite end of the support bar and extending through a horizontal slot in the frame to threadibly receive a wing nut.

13 Claims, 1 Drawing Sheet

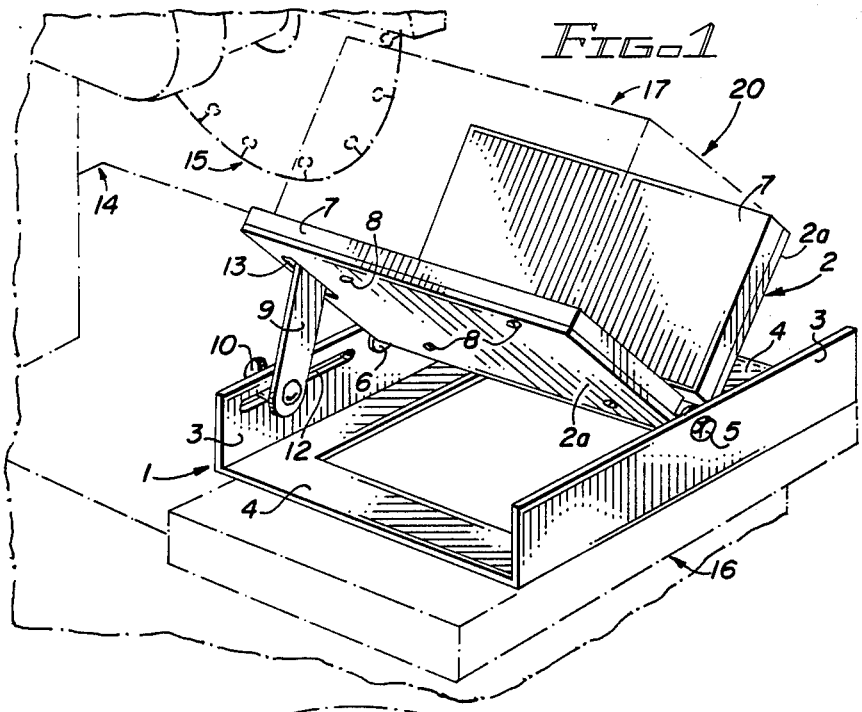
FIG. 1
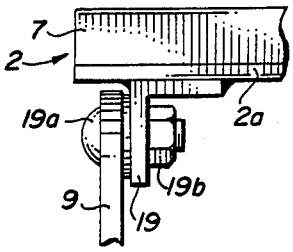
FIG. 4
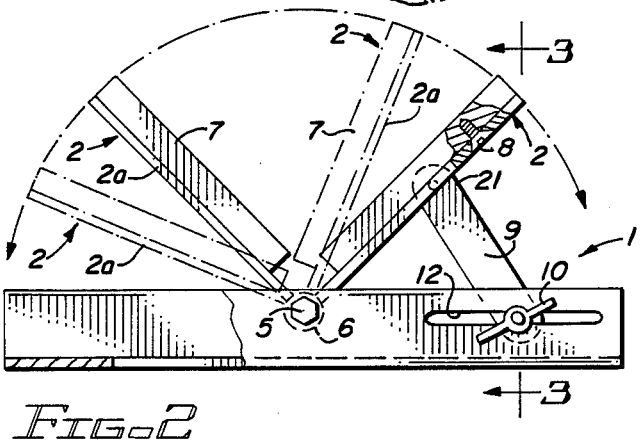
FIG. 2
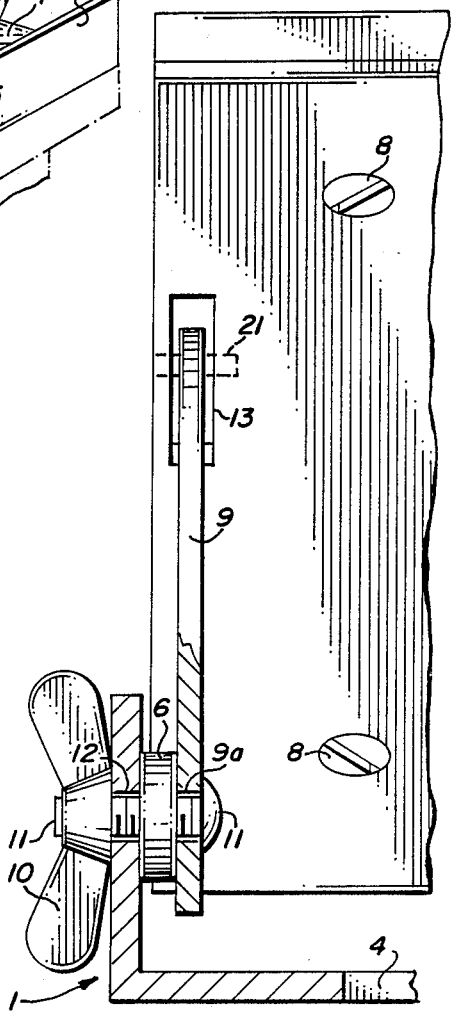
FIG. 3
FIG. 5
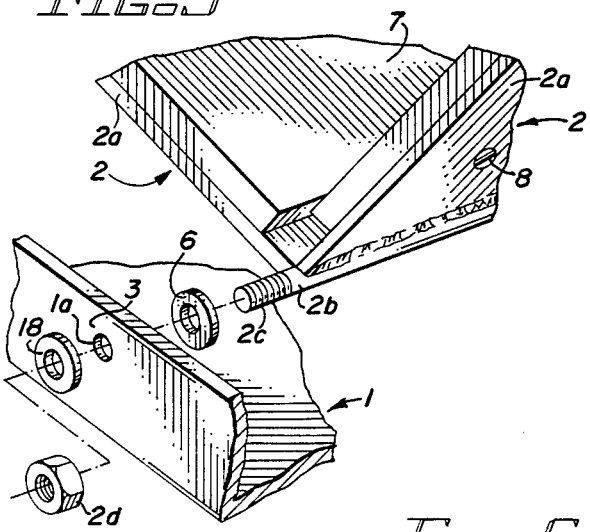
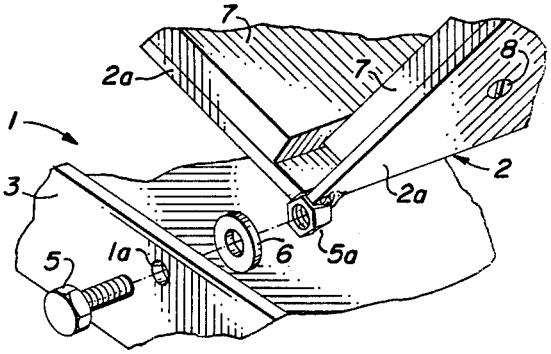
FIG. 6

MASONRY SAW JIG

BACKGROUND OF THE INVENTION

FIELD OF THE INVENTION

This invention relates to devices for supporting flat, cube or bar-shaped stock, such as bricks, tile and masonry blocks on masonry saws for cutting at various angles. The nature of construction employing these types of materials often requires that the material be cut at various angles, although most masonry saws are designed only for 90 degree cutting.

In today's architecture, tile, masonry blocks and bricks are extensively used in both structural and ornamental applications. Being both strong and ornamental, these materials facilitate rapid construction of structures that are beautiful, sound and reasonably inexpensive. The savings incurred by using these types of materials can be significant and a beautiful finish can be realized from basic building blocks. In order to maximize this advantage, those who build with these blocks must have tools that are capable of cutting precise angles. Due to the bulk and weight of bricks and masonry blocks, tools which are used in the shaping and preparation of these building materials must be as strong and durable as possible. Also, because of the required speed of construction using these materials, the tools used must be highly portable. In light of these factors, a need clearly exists for a workpiece or workstock holder for masonry saws that is precise, strong and highly portable.

There have been attempts in the past to design such a holder. One such design is described in U.S. Pat. No. 3,463,137, issued Aug. 27, 1969, to M. J. Hare. This design, unlike the one submitted in this application, lacks mobility, in that it includes the complete stock support and moving platform arrangement for a masonry saw, rather than a detachable accessory. The entire platform must then be removed and replaced for very heavy, 90 degree cutting. Furthermore, the design is too complicated to provide the necessary strength at a reasonable cost of construction and the bed is also designed so that one side of the stock to be cut must extend over the side of the bed. This means that one segment of the workstock or workpiece may be damaged as it falls from the saw, thus resulting in waste or that the workman's hand be in the immediate vicinity of the saw blade. Falling waste material can also be a safety hazard in such a situation. Another serious defect in the Hare design is an inadquate system of angle adjustment. The adjustment includes a bolt, wing nut and a pair of spaced, vertical, arcuate slots and does not allow for accurate, minute adjustments in the cutting angle. Also, due to the fact that the slots are primarily vertically-oriented, the adjustment setting is maintained entirely by the friction between the heel of the wing nut and the sides of the slots. This is seriously inadequate because of the weight of the material being cut and the downward pressure of the saw blade during the cutting operation. A shift in angle setting during a cut could cause binding of the saw and might also result in a broken blade and undue strain on the saw motor, as well as the workpiece being thrown from the saw. In any event, the workpiece may not be accurately cut. U.S. Pat. No. 2,464,117, dated Mar. 8, 1988, to H. C. Coates, details a "Conveyor Cart For Masonry Saws", which includes a structure for releasably clamping masonry workpieces in place at a selected angle for engagement by the cutting disk of the saw. A "Masonry Saw Jig" is detailed in U.S. Pat. No. 4,315,494, dated Feb. 16, 1982, to M. DiPlacido and includes a mitre guide jig having a body portion and an end portion adjustably attached to the body portion. The body portion further includes a single, flat workpiece-receiving face which is bordered by at least one raised side rail and moves through a variety of tile-cutting positions with adjustment of the body portion. The design set forth in this application will alleviate these, as well as other problems which are apparent in sawing masonry blocks, bricks and similar masonry at various angles by providing a simple, strong, safe, efficient, accurate and highly portable masonry workpiece support system.

It is an object of this invention to provide a new and improved masonry saw jig having a frame, a V-shaped bed pivotally attached to the frame and a support bar having one end pivotally secured to the V-shaped bed, with the opposite end of the support bar slidably attached to the frame for secure and accurate adjustment of the V-shaped bed with respect to the frame.

Another object of this invention is to provide an adjustable workpiece or workstock holder or masonry saw jig which includes a frame for resting on the workpiece support or base of a masonry saw beneath the saw blade, a V-shaped bed pivotally carried by the frame and a support bar having one end pivotally secured in a slot located in the V-shaped bed and the opposite end slidably disposed adjacent to a horizontal slot located in the jig frame and connected to the frame by a bolt extending through the slot, for adjusting the V-shaped bed and a workpiece placed therein, with respect to the frame and the masonry saw blade.

SUMMARY OF THE INVENTION

These and other objects of the invention are provided in a new and improved masonry saw jig for adjustably supporting bricks, tile and other masonry workstock or workpieces for cutting at selected angles by a masonry saw, which masonry saw jig includes a frame for seating on the workpiece support or base of a masonry saw, a V-shaped workpiece bed provided with removable wooden inserts, mounted in pivotal relationship between oppositely-disposed, upward-turned sides of the frame and a support bar having one end pivotally mounted in a slot or on an L-shaped bracket located in one of the V-shaped bed members or plates and the opposite end of the bar slidably mounted by means of a bolt and a wing nut to a horizontal slot provided in one of the sides of the frame.

BRIEF DESCRIPTION OF THE DRAWINGS

The invention will be better understood by reference to the accompanying drawing, wherein:

FIG. 1 is a front elevation of a preferred embodiment of the masonry saw jig of this invention;

FIG. 2 is a side view of the masonry saw jig illustrated in FIG. 1;

FIG. 3 is a sectional view taken along line 3—3 of the masonry saw jig illustrated in FIG. 1, FIG. 4 is a sectional view of an alternative bracket arrangement for securing the support bar to the V-shaped bed of the masonry saw jig illustrated in FIG. 1;

FIG. 5 is an exploded view, partially in section, illustrating an alternative preferred configuration for pivotally securing the V-shaped bed to the frame; and FIG. 6 is an exploded view, partially in section, illustrating a preferred technique for pivotally securing the V-shaped bed to the frame.

DETAILED DESCRIPTION

Referring to FIGS. 1, 2 and 6 of the drawing, it is seen that the masonry saw jig 20 includes a frame 1, designed to rest on the saw base 16 of a a masonry saw 14, a V-shaped bed 2 pivotally attached to the frame 1 and a support bar 9, for adjusting the angle of the V-shaped bed 2 with respect to the frame 1. Because the frame 1 is always disposed at a 90 degree angle with respect to the vertically-oriented saw blade 15 which is mounted on the masonry saw 14, an adjustment of the angle of disposition of the V-shaped bed 2 also represents an adjustment of the angle of the cut to be made in a workstock or workpiece 17, such as a brick. The frame 1 is formed by two lengths of angle iron 3 which are welded or otherwise connected laterally by two lengths of steel plate or strap 4. The parallel upright flanges of the angle iron 3 form the front and rear faces of the frame 1. In a preferred embodiment of the invention the V-shaped bed 2 is pivotally mounted to the front and rear lengths of the upright flanges of the angle iron 3 by two bolts 5, each bolt 5 passing through frame openings 1*a*, provided in the upright flanges of the angle iron 3, respectively, and through a pair of washers 6, and finally seating in the oppositely-disposed bed nuts 5*a*, which are mounted in the bottom edges of the V-shaped bed 2. This mount provides a simple, yet strong frame 1 and an easily adjustable pivotal mounting for the workpiece-supporting V-shaped bed 2.

A separate wooden insert 7 is mounted to each of the two adjacent plates 2*a* of the V-shaped bed 2. The wooden inserts 7 are secured to the plates 2*a*, respectively, by multiple wood screws 8, and are therefore replaceable, a feature which allows the masonry saw jig 20 to be used in such a way that each segment of the workpiece 17 located on both sides of a cut made by the saw blade 15 is supported by the V-shaped bed 2. This is due to the fact that the V-shaped bed 2 is not itself cut when contact between the saw blade 15 and the workpiece 17 is made. By supporting the workpiece 17 on both sides of the cut, possible damage to each severed segment of the workpiece 17 is avoided, since both segments of the workpiece 17 are cradled in the V-shaped bed 2. This is especially important due to the fact that in many cases, such as a corner-to-corner 45 degree angle cut, both segments of the brick, tile or other workpiece 17 being cut are to be used in a building construction.

The mechanism for adjusting the V-shaped bed 2 relative to the frame 1 includes a support bar 9, a wing nut 10, a support bar bolt 11 and a horizontal slot 12, located in one of the upward-standing flanges in an angle iron 3 of the frame 1. In the masonry saw jig 20 design depicted in FIGS. 1 and 2, the support bar 9 is located on the angle iron 3 flange which faces the masonry saw 14. However, it will be appreciated that the support bar 9 may easily be located on the opposite length of angle iron 3, as desired. The support bar 9 is pivotally attached at one end to one of the plates 2*a* of the V-shaped bed 2. This assembly is effected in a first preferred embodiment by inserting the upper end of the support bar 9 into a plate slot 13, provided in the plate 2*a* and securing it with a pin 21, as illustrated in FIG. 3. A bolt 11 passes through a bar opening 9*a*, provided in the lower end of the support bar 9 and then through the horizontal slot 12, provided in the vertical flange of the length of angle iron 3, as further illustrated in FIG. 3, to slidably mount the lower end of the support bar 9. A wing nut 10 is then threaded on the bolt 11 and when the wing nut 10 is loosened, the support bar bolt 11 and the corresponding lower end of the support bar 9 may be moved laterally along the horizontal slot 12, thus changing the angle of the V-shaped bed 2 with respect to the frame 1 as the V-shaped bed 2 pivots on the two bolts 5 and on the pin 21. When tightened on the support bar bolt 11, the wing nut 10 restricts lateral movement of the support bar bolt 11 in the horizontal slot 12, thus securely maintaining the angle of the V-shaped bed 2 with respect to the frame 1 and the saw blade 15. The pressure exerted upon the V-shaped bed 2 by the weight of the workpiece 17 being cut, as well as the force exerted upon the workpiece 17 by the saw blade 15 during the cutting operation, is bourne by the contact point between the support bar bolt 11 and the edge of the horizontal slot 12. The V-shaped bed 2 is thus rendered immobile with respect to the frame 1, unlike the prior art devices, wherein setting of a desired angle is maintained merely by the friction between the heel of a wing nut and the sides of a primarily vertical slot or slots. The wing nut 10 in the masonry saw jig 20 depicted in FIGS. 1 and 2 is responsible for stabilizing the bolt 11 and preventing it from vibrating laterally along the horizontal slot 12. This design facilitates an enormous advantage in strength and security in maintaining a selected angle between the V-shaped bed 2 and the frame 1. Furthermore, using the adjustment noted above, the angle of the cut in the workpiece 17 by the saw blade 15 is also much easier to vary and set in small increments. This is due to the fact that, unlike the prior art heretofore mentioned, a large lateral movement in the bolt 11 is required to obtain a corresponding small alteration in the angle of the V-shaped bed 2 with respect to the frame 1.

Referring now to FIG. 5 of the drawing, in an alternative preferred embodiment of the invention the V-shaped bed 2 is provided with an extending plate rod 2*b*, which projects from both ends of the plates 2*a* and is fitted at each end with plate rod threads 2*c*. A pair of plate rod nuts 2*d* are threaded on the plate rod threads 2*c* after the plate rod 2*b* is extended through the washer 6 and the respective frame openings 1*a*. A lock washer 18 may be provided on the plate rod 2*b* between the plate rod nut 2*d* and the angle iron 3, at a point in alignment with and opposite the washer 6, in order to better secure the V-shaped bed 2 to the frame 1. Still further in the alternative, the plates 2*a*, or that portion of the plates 2*a* which join at the bottom edge may be sufficiently thick to facilitate drilling and tapping, in order to accommodate the bolts 5, as desired.

As further illustrated in FIG. 4, in another alternative embodiment of the invention an L-shaped support bar bracket 19 is welded or otherwise attached to the plate 2 which corresponds to the vertical flange of the angle iron 3 having the horizontal slot 12 therein. A bracket bolt 19*a* extends through registering openings (not illustrated) in the upper end of the support bar 9 and the support bar bracket 19, to receive a bracket nut 19*b*, in order to pivotally secure the upper end of the support bar 9 to the plate 2*a*.

While the preferred embodiments of the invention have been described above, it will be recognized and understood that various modifications may be made therein and the appended claims are intended to cover all such modifications which may fall within the spirit and scope of the invention.

Having described my invention with the particularity set forth above, what is claimed is:

1. A masonry saw jig adapted for supporting a masonry work piece at various angles for cutting by a masonry saw, comprising:

(a) a frame;

(b) an elongated, substantially V-shaped work piece bed having a right plate and a left plate, said right plate and said left plate further characterized by an upper and lower edge and joined along said lower edge to form a "V", said V-shaped bed pivotally mounted to said frame; and (c) a support bar having one end pivotally secured to a selected one of said right plate and said left plate in said V-shaped bed, a bolt carried by said lower end of said support bar, a horizontal slot located in said frame, with said bolt extending in slidable relationship through said horizontal slot, and tightening means threaded on said bolt for adjusting said bolt in said horizontal slot and adjusting and maintaining said V-shaped bed in said various angles and cutting the masonry work piece responsive to operation of the masonry saw.

2. The masonry saw jig as recited in claim 1 further comprising a pair of work piece inserts removable affixed to said right plate and said left plate, respectively, for receiving a work piece and wherein said work piece inserts each further comprise a wooden block of selected thickness.

3. The masonry saw jig as recited in claim 1 further comprising a pair of bolts traversing said frame, respectively, said bolts threadibly seating in opposite ends of said "V"-shaped bed at said lower edge of said plates.

4. The masonry saw jig as recited in claim 1 wherein said tightening means further comprises a wing nut.

5. The masonry saw jig as recited in claim 1 wherein said tightening means further comprises a nut.

6. The masonry saw jig as recited in claim 1 wherein said frame further comprises two lengths of angle iron disposed in spaced relationship and two steel straps connecting said lengths of angle iron, each of said lengths of angle iron having a horizontal and a vertical flange, said workpiece bed is pivotally attached to said vertical flange, respectively, and said horizontal slot is provided in said vertical flange.

7. The masonry saw jig as recited in claim 2 wherein said workpiece inserts each further comprise a wooden block of selected thickness.

8. The masonry saw jig as recited in claim 7 wherein said tightening means further comprises a wing nut.

9. The masonry saw jig as recited in claim 7 wherein said tightening means further comprises a nut.

10. A masonry saw jig adapted for supporting a masonry work piece at various angles for cutting by a masonry saw, comprising:

(a) a frame characterized by two lengths of angle iron disposed in spaced relationship and two steel straps connecting said lengths of angle iron, each of said lengths of angle iron having a horizontal and a vertical flange, said frame adapted for location beneath the masonry saw;

(b) a generally V-shaped work piece bed having a right plate and a left plate joined at one edge to define a base, with said base pivotally mounted to said vertical flange, respectively, of said frame at said one edge; and (c) an elongated, flat support bar having one end pivotally secured to a selected one of said right plate and said left plate in said V-shaped work piece bed, a bolt carried by said lower end of said support bar, a horizontal slot located in vertical flange with said bolt extending through said horizontal slot and tightening means threaded on said bolt for adjusting said bolt in said horizontal slot and maintaining said work piece bed in said various angles and cutting the masonry work piece responsive to operation of the masonry saw.

11. The masonry saw jig as recited in claim 10 further comprising a pair of workpiece inserts removably carried by said right plate and said left plate, respectively, for supporting the masonry workpiece.

12. The masonry saw jig as recited in claim 11 wherein said workpiece inserts each further comprise a wooden block of selected thickness.

13. The masonry saw jig as recited in claim 10 wherein said tightening means further comprises a wing nut.

* * * * *